US005999779A

United States Patent [19]

Takeuchi

[11] Patent Number: 5,999,779

[45] Date of Patent: Dec. 7, 1999

[54] DEVELOPING DEVICE FOR AN IMAGE FORMING APPARATUS

[75] Inventor: Noriyasu Takeuchi, Kanagawa, Japan

[73] Assignee: Ricoh Company, Ltd., Tokyo, Japan

[21] Appl. No.: 09/205,719

[22] Filed: Dec. 4, 1998

[30] Foreign Application Priority Data

Dec. 5, 1997 [JP] Japan ..... 9-350261

[51] Int. Cl.[6] ..... B05C 11/00; G03G 15/10

[52] U.S. Cl. ..... 399/239; 118/679; 399/236; 399/237

[58] Field of Search ..... 399/236, 237, 399/239, 53; 118/679, 688, 689, 690

[56] References Cited

U.S. PATENT DOCUMENTS

| | | | |
|---|---|---|---|
| 3,921,580 | 11/1975 | Kase | 355/3 |
| 4,230,782 | 10/1980 | Goffe | 430/41 |
| 4,325,627 | 4/1982 | Swidler et al. | 355/10 |
| 4,689,936 | 9/1987 | Chow | 118/661 |
| 5,708,938 | 1/1998 | Takeuchi et al. . | |

FOREIGN PATENT DOCUMENTS 7-295372 11/1995 Japan .

*Primary Examiner*—Matthew S. Smith
*Assistant Examiner*—Hoang Ngo
*Attorney, Agent, or Firm*—Oblon, Spivak, McClelland, Maier & Neustadt, P.C.

[57] ABSTRACT

A developing device for developing a latent image electrostatically formed on an image carrier includes an endless developing belt, and an applicator roller for applying a viscous developing liquid consisting of a dielectric carrier liquid and toner dispersed in the carrier liquid to the developing belt in the form of a thin layer. The developing liquid is transferred from the developing belt to the image carrier for developing the latent image. The applicator roller holds a preselected amount of the developing liquid thereon, contacts a portion of the developing belt not pressed from the rear side, and rotates in a direction opposite to a direction in which the developing belt moves. The device is therefore capable of uniformly applying the developing liquid to the developing belt and thereby improving image quality.

19 Claims, 6 Drawing Sheets

DEVELOPING DEVICE FOR AN IMAGE FORMING APPARATUS

BACKGROUND OF THE INVENTION

The present invention relates to an image forming apparatus including a photoconductive drum or belt or similar image carrier and more particularly to a developing device included in an image forming apparatus for causing a developing liquid in the form of a thin layer to contact and develop a latent image electrostatically formed on an image carrier.

It is a common practice with a developing device of the type described to use an applicator roller for applying a developing liquid to an image carrier in the form of a thin uniform layer. However, the conventional liquid application using an applicator roller has the following problems left unsolved. At the outlet of a nip where the applicator roller and a developer carrier contact each other, the developing liquid between the roller and the carrier is separated into a layer left on the roller and a layer transferred to the carrier. At this instant, cavitation occurs on the surfaces of such layers and brings about fine irregularities including spot-like voids and stripe-like ribs extending in the direction of movement of the developer carrier. The fine irregularities lower image quality. Further, if the developing liquid is not applied to the developer carrier in a constant amount, then the resulting image density is irregular.

SUMMARY OF THE INVENTION

It is therefore an object of the present invention to provide a developing device for an image forming apparatus capable of applying a preselected amount of developing liquid to a developing roller at all times and thereby enhancing image quality.

A developing device for developing a latent image electrostatically formed on an image carrier of the present invention includes an endless developing belt, and an applicator roller for applying a viscous developing liquid consisting of a dielectric carrier liquid and toner dispersed in the carrier liquid to the developing belt in the form of a thin layer. The developing liquid is transferred from the developing belt to the image carrier for developing the latent image. The applicator roller holds a preselected amount of the developing liquid thereon, contacts a portion of the developing belt not pressed from the rear side, and rotates in a direction opposite to a direction in which the developing belt moves.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Briefly, a developing device of the present invention is applicable to a copier, facsimile apparatus, printer or similar image forming apparatus and develops a latent image electrostatically formed on an image carrier with a viscous developing liquid.

The developing device includes, e.g., a tank storing a viscous developing liquid, an applicator roller, a metering blade, a developing belt, tension rollers, and a belt cleaning blade. The developing liquid consists of a dielectric carrier liquid and toner dispersed therein. The applicator roller is implemented by, e.g., a photogravure roller capable of applying the developing liquid to the developing belt in the form of a thin layer. The photogravure roller customary with photogravure printing and flexography is formed with a photogravure pattern over its entire circumference. The applicator roller holds the developing liquid thereon by an amount corresponding to the total volume of cavities included in the photogravure pattern. The metering blade removes an excess part of the developing liquid from the applicator roller. The applicator roller is therefore capable of holding a preselected amount of liquid thereon in cooperation with the metering blade.

The developing belt is held under a preselected degree of tension by tension rollers. In this condition, the developing liquid applied to the belt by the applicator roller in the form of a thin layer is brought into contact with a latent image formed on the image carrier. As a result, the latent image is developed to turn out a toner image. The belt cleaning blade removes the liquid left on the belt after the development and thereby cleans the belt.

The applicator roller contacts the developing belt at a position where the belt is not pressed from the rear side. Further, the roller moves in the opposite direction to the belt, as seen at a nip between the roller and the belt, while applying the developing liquid to the belt. Therefore, the liquid is applied to the belt in a constant amount and develops the latent image of the image carrier with constant density at all times.

Figure 1:
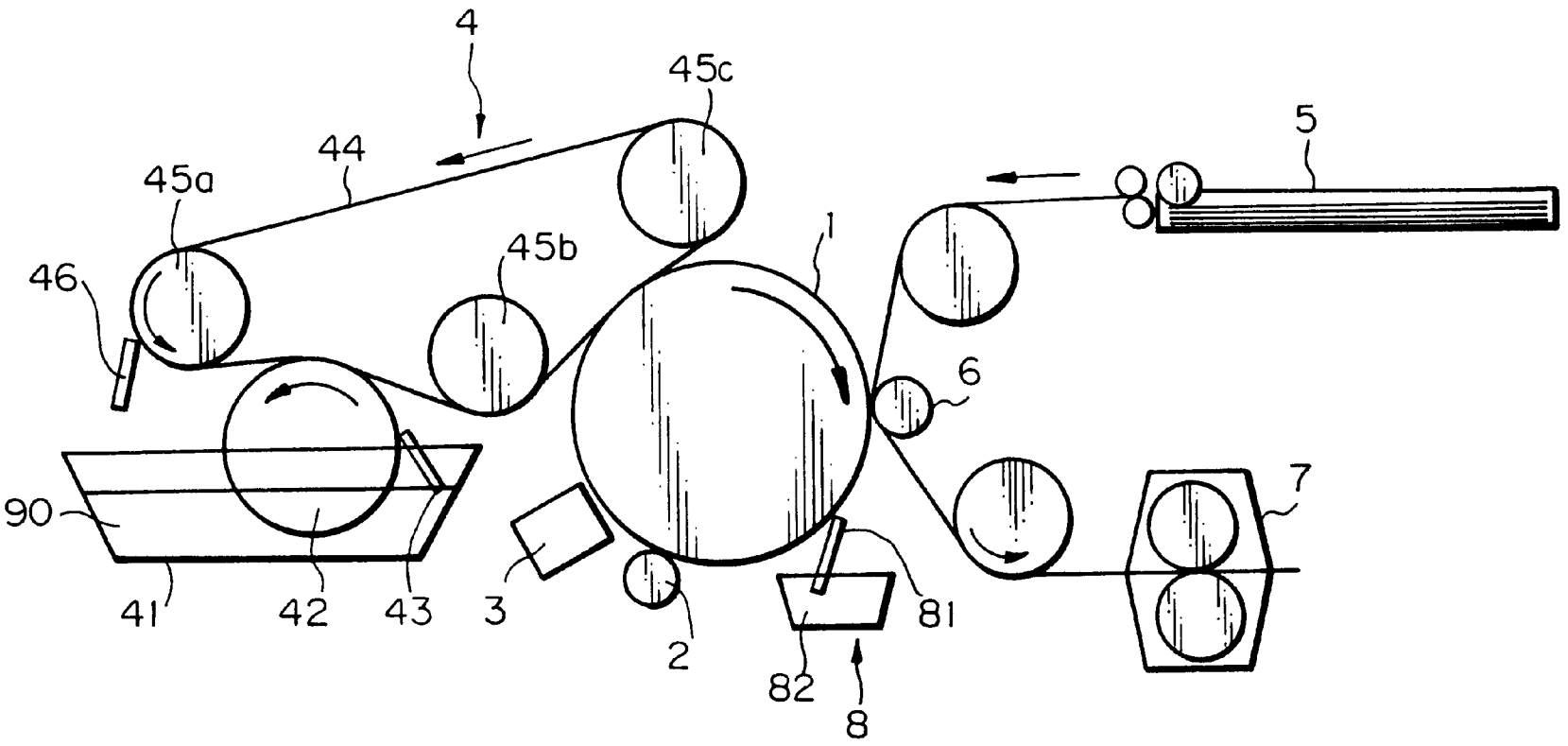
FIG. 1 shows a developing device embodying the present invention and an image forming apparatus using the same.

Referring to FIG. 1 of the drawings, a developing device embodying the present invention is shown together with an image forming apparatus using the developing device. As shown, the image forming apparatus includes a photoconductive element or image carrier implemented as a drum 1, a charge roller 2, an optical unit 3 for exposure, a developing device 4, a paper feed section 5 a transfer unit 6, a fixing unit 7, and a cleaning unit 8. The charge roller 2 uniformly charges the surface of the drum 1. The optical unit 3 exposes the charged surface of the drum 1 in accordance with image data received from a scanner, not shown, or a host, not shown, thereby electrostatically forming a latent image on the drum 1.

Figure 2:
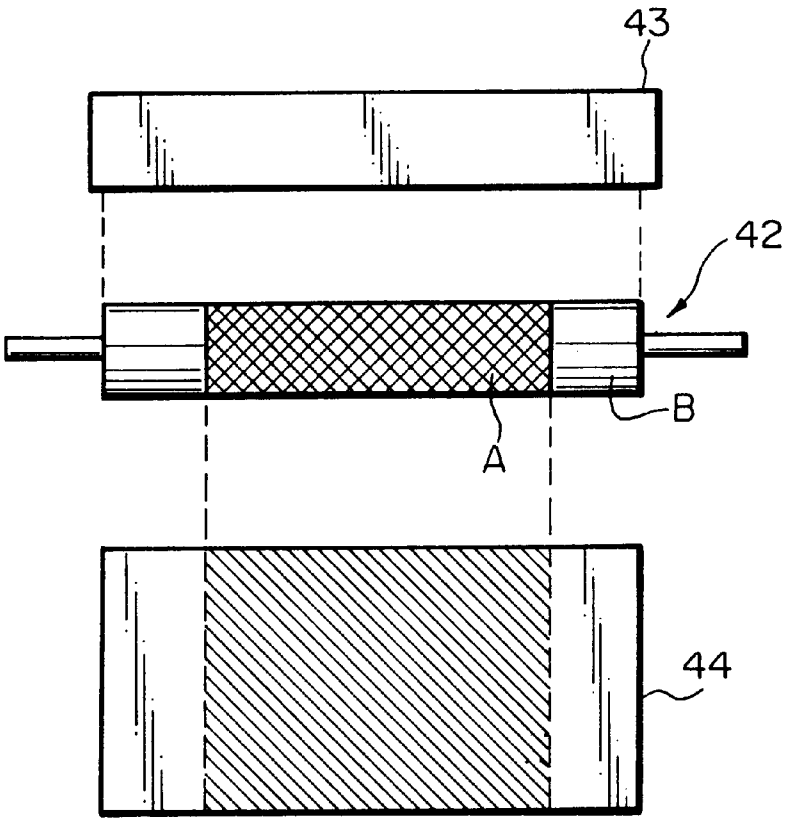
FIG. 2 shows a relation between a pattern area provided on an applicator roller included in the illustrative embodiment and a developing belt also included in the illustrative embodiment.

The developing device 4 includes, e.g., a tank 41 storing a viscous developing liquid 90, an applicator roller 42, a metering blade 43, an endless developing belt 44, a drive roller 45*a* for driving the belt 44, tension rollers 45*b* and 45*c*, and a belt cleaning blade 46. The developing liquid 90 stored in the tank 41 consists of a dielectric carrier liquid and toner dispersed thereon. As shown in FIG. 2 specifically, the applicator roller 42 is implemented by a photogravure roller having a pattern area A and non-pattern areas B positioned at both sides of the pattern area A. The pattern area A extends over the entire circumference of the roller 42 at the axially center portion of the roller 42 and is formed with a photogravure pattern. The applicator roller 42 applies the developing liquid 90 to the developing belt 44 such that the liquid 90 forms a thin layer on the belt 44.

The applicator roller 42 holds the developing liquid 90 by an amount corresponding to the total volume of cavities present in the photogravure pattern. The metering blade 43 removes an excess part of the developing liquid 90 from the applicator roller 42. In this manner, the applicator roller 42 holds a preselected amount of the developing liquid 90 thereon in cooperation with the metering blade 43.

Further, the pattern area A of the applicator roller 42 has a width smaller than the width of the developing belt 44, so that the developing liquid 90 is not applied to opposite edge portions of the belt 44. The liquid 90 is therefore prevented from turning round to the rear of the belt 44. This successfully prevents the drive roller 45*a* and belt 44 from slipping on each other and prevents the liquid 90 from dripping.

Figure 3:
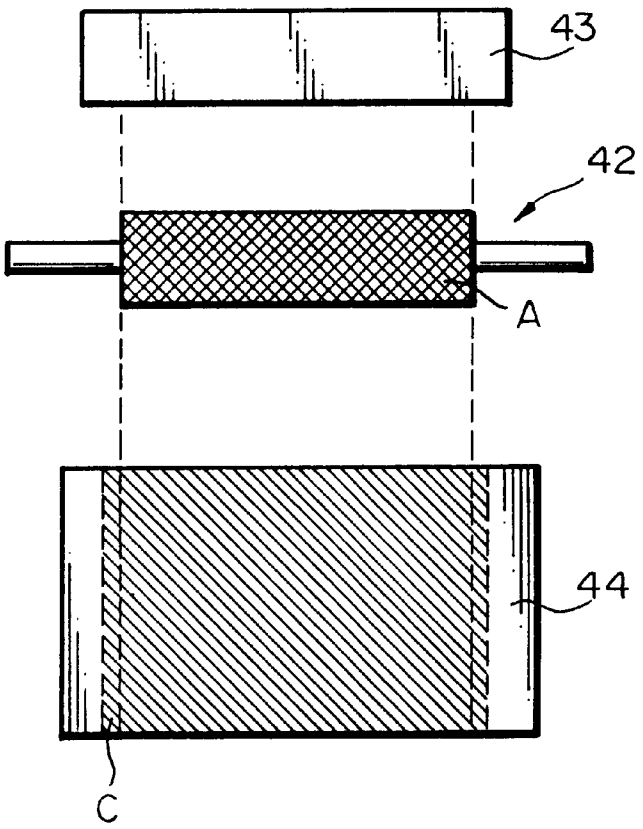
FIG. 3 shows a relation between an applicator roller lacking non-pattern areas and the developing belt.

Assume that the non-pattern areas B at both sides of the pattern area A are absent. Then, as shown in FIG. 3, even when the pattern area A is smaller in width than the developing belt 44, the excess developing liquid 90 deposits on the portions C of the belt 44 corresponding to the opposite edge portions of the applicator roller 42. Although the portions C are non-image areas and do not directly influence image quality, the liquid 90 deposited on the portions C is wasteful. By contrast, the non-pattern areas B formed at both sides of the pattern area A obviate the wasteful consumption of the liquid 90.

The applicator roller 42 contacts the developing belt 44 at a position where the belt 44 is not pressed from the rear side. Therefore, the contact condition of the roller 42 with the belt 44 is determined solely by the tension of the belt 44. This allows the roller 42 to stably contact the belt 44 even if the positional accuracy of the roller 42 is not high. In addition, the roller 42, located at such a position needs only a minimum of torque for rotation and therefore scales down a drive arrangement while promoting power saving. Further, in the illustrative embodiment, the roller 42 moves in the opposite direction to the belt 44, as seen at a nip between the roller 42 and the belt 44, while applying the developing liquid to the belt 44. This obviates the previously discussed ribs ascribable to the separation of the liquid 90. In this manner, the liquid 90 is applied to the belt 44 in a constant amount and develops the latent image of the drum 1 with constant density at all times.

The developing belt 44 is held under a preselected degree of tension by the drive roller 45*a* and tension rollers 45*b* and 45*c*. In this condition, the developing liquid 90 applied to the belt 44 by the applicator roller 42 in the form of a thin layer is brought into contact with the latent image formed on the drum 1. As a result, the latent image is developed to turn out a toner image. The belt cleaning blade 46 removes the liquid 90 left on the belt 44 after the development and thereby cleans the belt 44.

The paper feed section 5 feeds papers one by one in synchronism with the formation of consecutive toner images on the drum 1. The transfer unit 6 transfers the toner image formed on the drum 1 to the paper fed from the paper feed section 5. The fixing unit 7 fixes the toner image on the paper. The cleaning unit 8 scrapes off the developing liquid 90 left on the drum 1 after the image transfer with a blade 81. The liquid 90 removed by the blade 81 is stored in a waste liquid tank 82.

Figure 4:
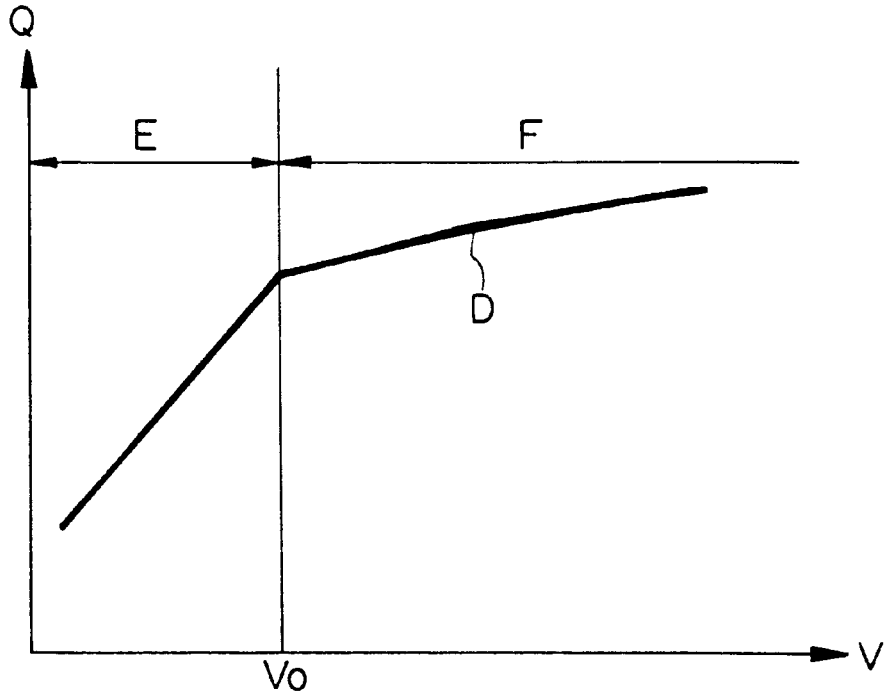
FIG. 4 shows a relation between the amount of application of a developing liquid and the peripheral speed of the applicator roller.

FIG. 4 shows a curve D representative of a relation between the peripheral speed V of the applicator roller 42 and the amount Q of the developing liquid 90 applied to the developing belt 44. As shown, in a range E wherein the peripheral speed V is lower than the moving speed Vo of the belt 44, the amount Q of liquid application is irregular due to the influence of the photogravure pattern. However, in a range F wherein the peripheral speed V is higher than the speed Vo, the amount Q is regular, i.e., substantially proportional to the peripheral speed V. In light of this, the peripheral speed V may be switched in the range F in order to adjust the amount Q of liquid application and therefore image density.

Figure 5:
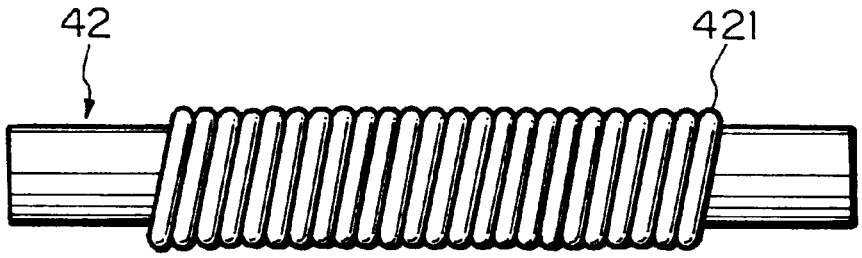
FIG. 5 is a side elevation showing another specific configuration of the applicator roller.

FIG. 5 shows a wire roller which may be substituted for the photogravure roller. As shown, the wire roller, also labeled 42, has a thin wire 421 spirally wound thereround. By changing the diameter of the wire 421, it is possible to control the fine gaps with ease.

Figure 6A:
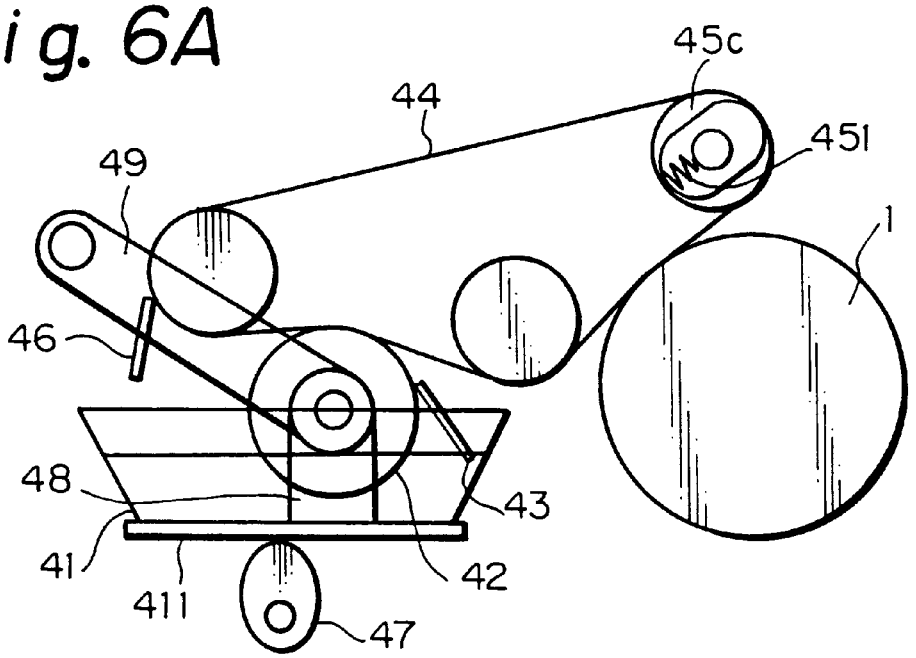
FIGS. 6A and 6B show a specific arrangement for moving the applicator roller into and out of contact with the developing belt.
Figure 6B:
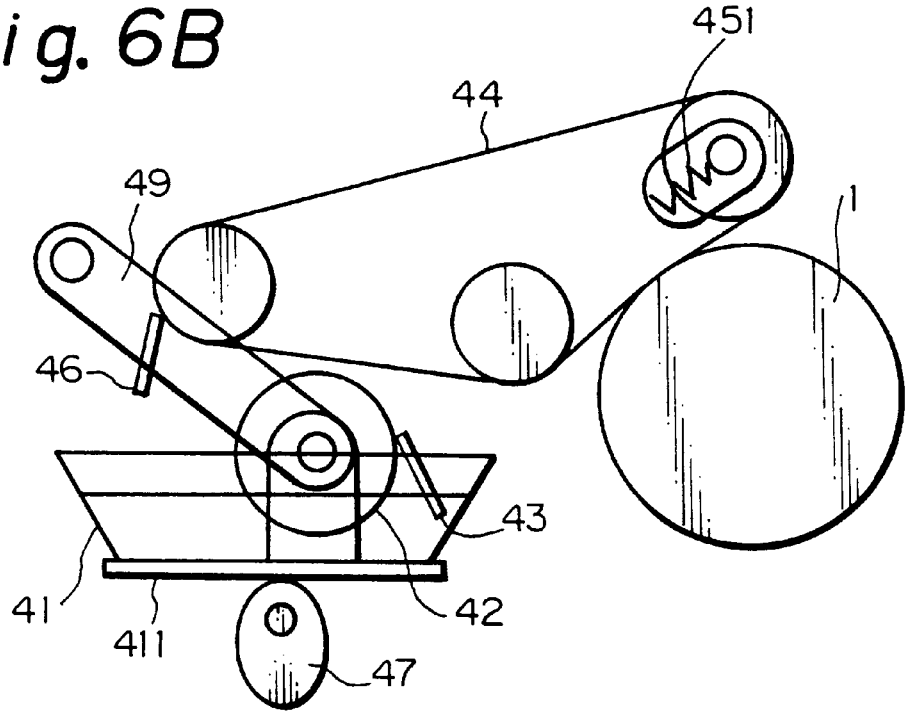

Assume that the image forming apparatus of the type using the developing belt 44 and developing liquid 90 is left unused over a long period of time with the liquid 90 remaining on the belt 44. Then, dust and other impurities are apt to deposit on the belt 44, and the liquid is apt to deposit on surrounding members at the time of, e.g., the replacement of the belt 44. FIGS. 6A and 6B show a specific implementation for solving this problem. As shown, a relatively thick bottom plate 411 is mounted on the bottom of the tank 41. The applicator roller 42 is supported by an upright post 48 extending upward from the bottom plate 411. A cam 47 is held in contact with the underside of the bottom plate 411. The cam 47 is rotatable to selectively move the roller 42 into or out of contact with the belt 44.

Specifically, as shown in FIG. 6A, the roller 42 is brought into contact with the belt 44 during development. As shown in FIG. 6B, the roller 42 is spaced from the belt 44 when development is not effected, allowing the liquid 90 to be fully removed from the belt 44. This obviates the deposition of dust and other impurities on the belt 44 ascribable to the liquid 90.

Further, in the configuration shown in FIGS. 6A and 6B, the roller 42 is supported by an angularly movable arm 49 as well as by the post 48. The arm 49 prevents the roller 42 from being dislocated. When the roller 42 is released from the belt 44, a spring 51 absorbs a decrease in the tension of the belt 44 and thereby prevents the belt 44 from slackening.

Figure 7A:
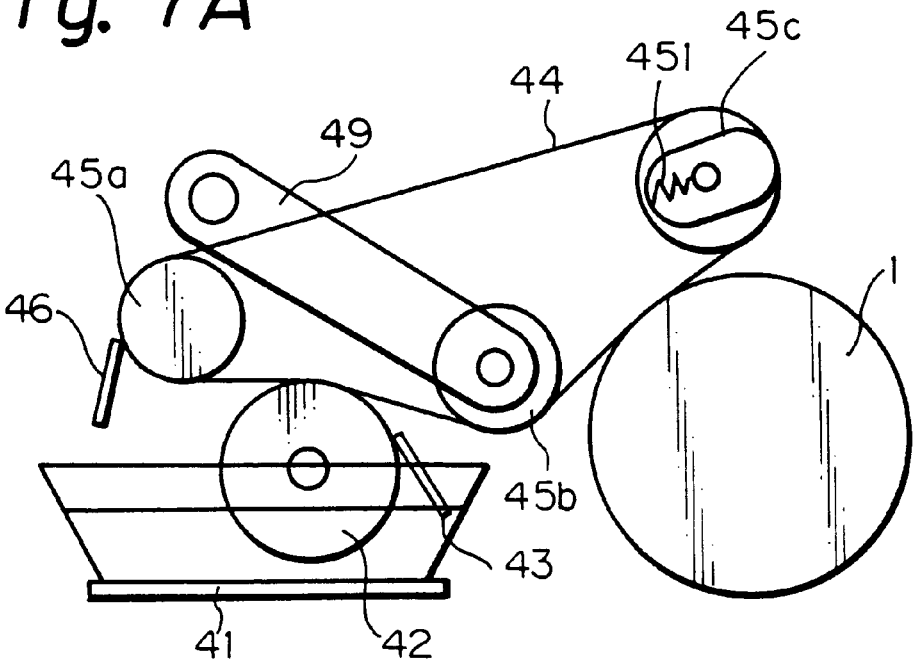
FIGS. 7A and 7B show a specific arrangement for moving the developing belt into and out of contact with the applicator roller.
Figure 7B:
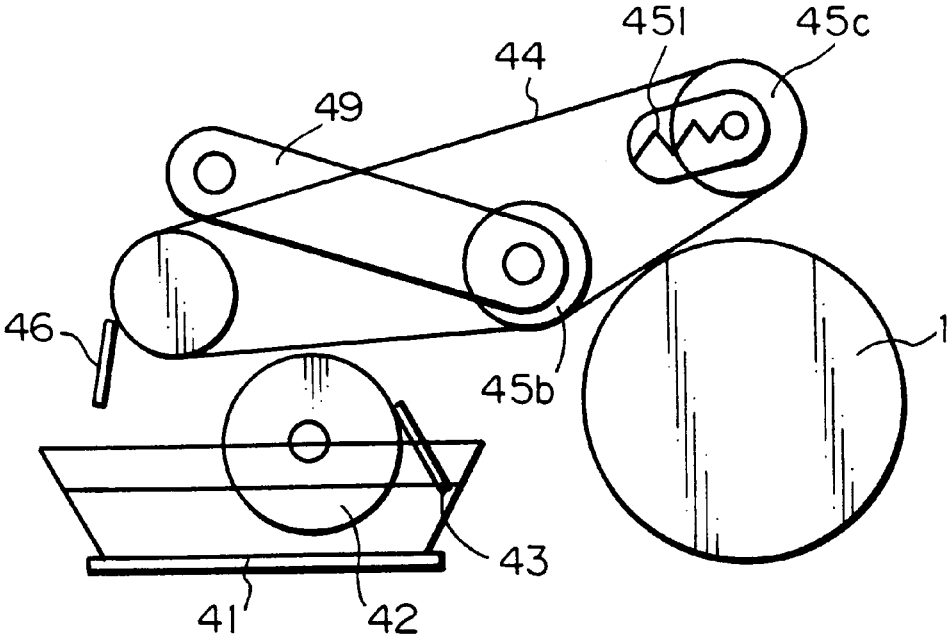

FIGS. 7A and 7B show another specific arrangement for solving the above dust deposition problem. As shown, the arrangement is such that the tension roller 45*b* is movable in the up-and-down direction in order to selectively bring the belt 44 into or out of contact with the roller 42. This configuration is practicable with a smaller number of parts than the configuration shown in FIGS. 6A and 6B.

Figure 8:
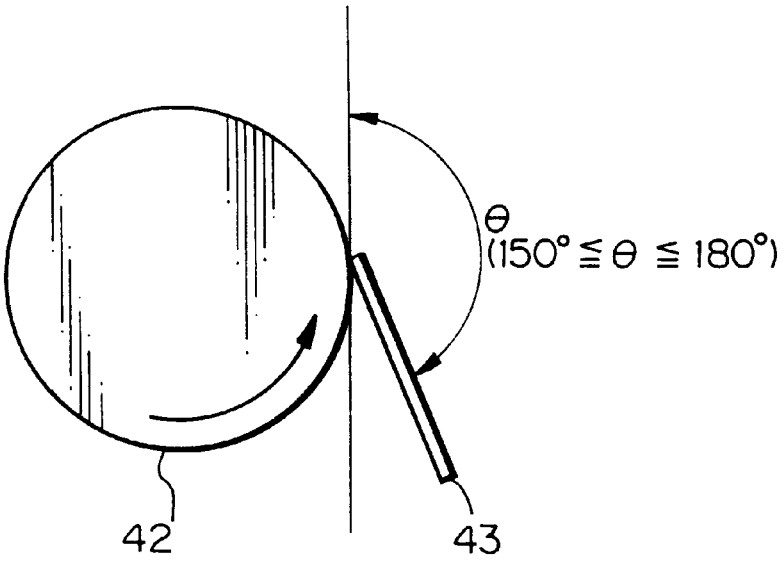
FIG. 8 is a side elevation showing the applicator roller.

As shown in FIG. 8, it is preferable that the metering blade 43 for regulating the amount of liquid deposition on the applicator roller 42 contacts the roller 42 at an obtuse angle, preferably 150° to 180°, in the direction of rotation of the roller 42. Such an angle reduces the wear of the roller 42 and that of the blade 43 and thereby extends their lives (?).

The applicator roller 42 is more expensive and more difficult to replace than the metering blade 43. In this respect, the blade 43 may be provided with hardness lower than the hardness of the surface of the roller 42 for slowing down the wear of the roller 42. For example, assume that the roller 42 has its surface plated with nickel by heat treatment so as to have a surface hardness ranging from 650 to 750 (Hv). Then, the blade 43 is formed of quenched carbon steel (SK) to have a hardness of 450 to 510 (Hv). Further, when the roller 42 is plated with nickel-boron to have a surface hardness of 1,100 to 1,200 (Hv), the blade 43 is formed of stainless steel to have a hardness of 360 to 380 (Hv).

Figure 9:
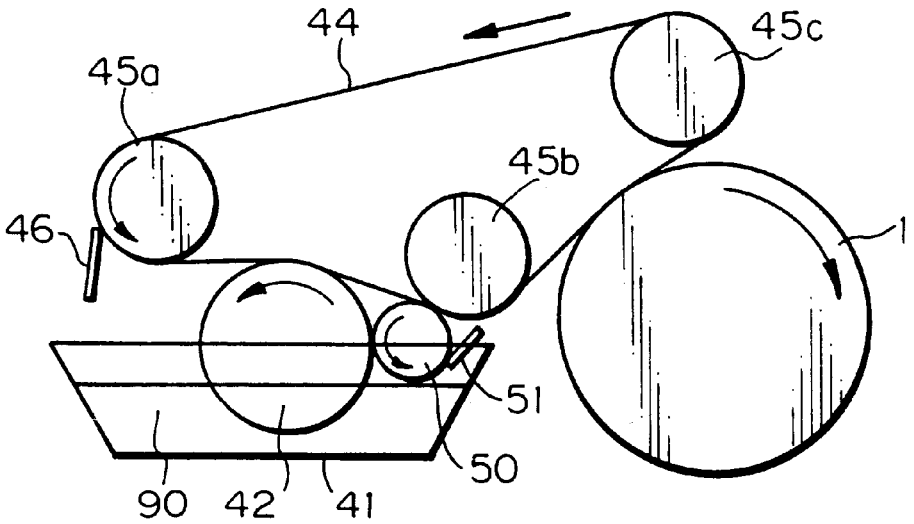
FIG. 9 shows a modification of the illustrative embodiment including a metering roller in place of a metering blade.

As shown in FIG. 9, the metering blade 43 may be replaced with a metering roller 50.

In summary, it will be seen that the present invention provides a developing device for an image forming apparatus having various unprecedented advantages, as enumerated below.

(1) A developing liquid is held on an applicator roller in a constant amount and therefore applied to a developing roller in a constant amount.

(2) The applicator roller contacts a portion of the developing belt which is not pressed from the rear side, so that the contact condition of the roller with the belt is determined solely by the tension of the belt. It follows that the liquid can be uniformly applied to the belt even when the positional accuracy of the roller is not high.

(3) The applicator roller moves in the opposite direction to the developing belt, as seen at a nip between the roller and the belt. This further promotes the uniform application of the liquid to the belt.

(4) The peripheral speed of the applicator roller is controlled, in accordance with the amount of liquid deposition on the developing belt, in a range wherein the peripheral speed of the roller is higher than the speed of the belt. This promotes easy density control.

(5) The applicator roller is released from the developing belt when the developing liquid is not to be applied to the belt. The liquid can therefore be fully removed from the belt when development is not effected, and prevents dust and other impurities form depositing on the belt.

(6) The applicator roller applies the developing liquid to the developing belt within a range preventing the liquid from spreading to the outside of the belt. The liquid is therefore prevented from turning round to the rear of the belt.

(7) The applicator roller is implemented by a photogravure roller having a pattern area narrower than the developing belt and non-pattern areas at both sides of the pattern area. The roller can therefore apply the developing liquid to the developing belt within the range preventing the liquid from spreading to the outside of the belt. In addition, the excess liquid is prevented from depositing on opposite edge portions of the belt.

(8) A blade regulates the amount of developing liquid deposited on the applicator roller and contacts the roller at an obtuse angle in the direction of rotation of the roller. This allows the amount of liquid deposition on the roller to be easily regulated and slows down the deterioration of the roller and blade.

(9) The deterioration of the developing roller is also slowed down because the blade has hardness lower than the surface hardness of the applicator roller.

Various modifications will become possible for those skilled in the art after receiving the teachings of the present disclosure without departing from the scope thereof.

What is claimed is:

1. A developing device developing a latent image electrostatically formed on an image carrier, comprising:

an endless developing belt; and an applicator roller configured to apply a viscous developing liquid including a dielectric carrier liquid and toner dispersed in said dielectric carrier liquid to said developing belt in a form of a thin layer, said developing liquid being transferred from said developing belt to the image carrier for developing the latent image;

said applicator roller holding a preselected amount of the developing liquid thereon, contacting a portion of said developing belt not pressed from a rear side, and rotating in a direction opposite to a direction in which said developing belt moves, wherein a peripheral speed of said applicator roller is controlled, in accordance with the amount of the developing liquid to be applied to said developing belt, in a range in which said peripheral speed is hither than a peripheral speed of said developing belt.

2. A developing device as claimed in claim 1, wherein said applicator belt is spaced from said developing roller when the developing liquid is not to be applied to said developing belt.

3. A developing device as claimed in claim 2, wherein said applicator roller applies the developing liquid to said developing belt within a range preventing said developing liquid from spreading to an outside of said developing belt.

4. A developing device as claimed in claim 3, wherein said applicator roller comprises a photogravure roller having a pattern area in a range thereof narrower than a width of said developing belt and non-pattern areas positioned at opposite sides of said pattern area.

5. A developing device as claimed in claim 4, further comprising a blade for regulating an amount of the developing liquid deposited on said applicator roller, said blade contacting said applicator roller at an obtuse angle in a direction of rotation of said applicator roller.

6. A developing device as claimed in claim 5, wherein said blade has a hardness lower than a surface hardness of said applicator roller.

7. A developing device as claimed in claim 1, wherein said applicator roller applies the developing liquid to said developing belt within a range preventing said developing liquid from spreading to an outside of said developing belt.

8. A developing device as claimed in claim 7, wherein said applicator roller comprises a photogravure roller having a pattern area in a range thereof narrower than a width of said developing belt and non-pattern areas positioned at opposite sides of said pattern area.

9. A developing device as claimed in claim 8, further comprising a blade for regulating an amount of the developing liquid deposited on said applicator roller, said blade contacting said applicator roller at an obtuse angle in a direction of rotation of said applicator roller.

10. A developing device as claimed in claim 9, wherein said blade has a hardness lower than a surface hardness of said applicator roller.

11. A developing device as claimed in claim 1, wherein said applicator belt is spaced from said developing roller when the developing liquid is not to be applied to said developing belt.

12. A developing device as claimed in claim 11, wherein said applicator roller applies the developing liquid to said developing belt within a range preventing said developing liquid from spreading to an outside of said developing belt.

13. A developing device as claimed in claim 12, wherein said applicator roller comprises a photogravure roller having a pattern area in a range thereof narrower than a width of said developing belt and non-pattern areas positioned at opposite sides of said pattern area.

14. A developing device as claimed in claim 13, further comprising a blade for regulating an amount of the developing liquid deposited on said applicator roller, said blade contacting said applicator roller at an obtuse angle in a direction of rotation of said applicator roller.

15. A developing device as claimed in claim 14, wherein said blade has a hardness lower than a surface hardness of said applicator roller.

16. A developing device as claimed in claim 1, wherein said applicator roller applies the developing liquid to said developing belt within a range preventing said developing liquid from spreading to an outside of said developing belt.

17. A developing device as claimed in claim 16, wherein said applicator roller comprises a photogravure roller having a pattern area in a range thereof narrower than a width of said developing belt and non-pattern areas positioned at opposite sides of said pattern area.

18. A developing device as claimed in claim 17, further comprising a blade for regulating an amount of the developing liquid deposited on said applicator roller, said blade contacting said applicator roller at an obtuse angle in a direction of rotation of said applicator roller.

19. A developing device as claimed in claim 18, wherein said blade has a hardness lower than a surface hardness of said applicator roller.

* * * * *